United States Patent [19]

Pass

[11] 4,065,104

[45] Dec. 27, 1977

[54] SCHOOL CROSSING BARRICADE

[76] Inventor: Sidney M. Pass, 910 Pickens Ave., Pensacola, Fla. 32503

[21] Appl. No.: 667,376

[22] Filed: Mar. 16, 1976

[51] Int. Cl.[2] ..... A01K 3/00

[52] U.S. Cl. ..... 256/13.1

[58] Field of Search ..... 256/1, 13.3, 64; 116/63 R, 63 P; 280/638, 114 R, 402

[56] References Cited

U.S. PATENT DOCUMENTS

| | | | |
|---|---|---|---|
| 2,812,041 | 11/1957 | Mugler | 16/35 R |
| 2,907,998 | 10/1954 | Conly | 116/63 P |
| 2,930,589 | 3/1960 | Blaskiewicz, Sr. | 256/64 |
| 3,798,814 | 3/1974 | Harmon | 116/63 P |
| 3,860,992 | 1/1975 | Legg | 16/35 R |
| 3,861,702 | 1/1975 | Wilson | 16/35 R |

*Primary Examiner*—Werner H. Schroeder
*Assistant Examiner*—Doris L. Troutman
*Attorney, Agent, or Firm*—Clarence A. O'Brien; Harvey B. Jacobson

[57] ABSTRACT

A portable barricade for use at school crossings, and the like, has a frame mounted on wheels or similar transporter devices, and is provided with at least one lamp assembly for warning parties approaching the barricade of the presence of a potentially hazardous condition. Attached to the frame is a brake which permits selective retention of the barricade in a desired position in a crosswalk or similar location for a predetermined length of time. Once the need for the barricade at the particular location has ended, the brake may be easily released and the frame moved to another location.

1 Claim, 7 Drawing Figures

10
12
14
18
24
26
28
30
40
42
44
46
48
50
52
54
56
58
60
62
64
70
82
84
86
A
B
S
3
STOP 24
26
30
32
34
36
38
W 28
32

SCHOOL CROSSING BARRICADE

BACKGROUND OF THE INVENTION

1. Field of the Invention

This invention relates generally to barricades, and particularly to a portable barricade for use in school crossings and similar locations.

2. Description of the Prior Art

A problem generally encountered around the country is the provision of warning devices at school crossings, and particularly at school crossings which impose exceptional risks to the children. Further, many schools across the country are on double sessions where one group of children goes to school in the morning and another group in the afternoon. The morning children sometimes go to school in the dark and the afternoon children often go home in the dark. This situation makes school crossings more dangerous than ever. Accordingly, it has become common in many locations to install permanent flashing lights at such crossings. These flashing lights, however, are very expensive and have the distinct disadvantage of being fairly permanent in nature. If the hazard was decreased due to termination of double sessions or by lessening of traffic at the particular crossing due to closing of the street, making the street one way, or re-routing of the bulk of the traffic, the lights become unnecessary and must either be operated at unnecessary expense, removed at considerable expense, or maintained idle with the result that expensive equipment is tied up where it is not needed.

It is known generally to provide portable harzard warning barricades. Examples of such devices are disclosed in U.S. Pat. Nos. 1,798,548, issued Mar. 31, 1931 to S. M. McCurdy; 3,380,429, issued Apr. 30, 1968 to F. A. Moinicken et al; and 3,490,749, issued Jan. 20, 1970 to C. F. Anderson. In particular, U.S. Pat. No. 3,482,820, issued Dec. 9, 1969 to J. A. Angello, discloses a travelling barricade provided with a pair of carriages in order to facilitate movement of the warning device.

SUMMARY OF THE INVENTION

It is an object of the present invention to provide a portable barricade specifically suited for use at school crossings and similar locations.

It is another object of the present invention to provide a portable barricade which may be easily rolled into position, as by one person, at dangerous school crossings and like locations.

It is still another object of the present invention to provide a portable barricade that will give greater protection, more flexibility, and require less expenditure of money for upkeep that the conventional flashing light warning systems commonly employed at school crossings.

It is yet another object of the present invention to provide a flashing light warning system for school crossings, and the like, that positions the lamps at a relatively low, easily recognizable position.

These and other objects are achieved according to the present invention by providing a portable barricade having: a frame movable over a support surface; a signal assembly mounted on the frame for warning parties approaching the barricade of the presence of a hazardous condition; and a brake mounted on the frame for permitting selective retention of the barricade in a desired position. Preferably, the frame includes wheels rotatably mounted thereon for permitting movement of the frame, although it is to be understood that other suitable transporter devices, such as skids and tracks, may be employed as conditions dictate.

The brake advantageously includes a brake arm pivotally mounted on the frame for movement between a disengaged position and a position engaging the support surface which supports the frame for restraining the frame from movement relative to the support surface. Preferably, the wheels movably supporting the frame include a pair of casters disposed adjacent an end of the frame, with the brake arm being pivotally mounted on the frame adjacent the casters and of a length sufficient to lift the casters from the surface supporting the frame when the brake arm is in the position engaging the support surface.

The brake advantageously further includes an actuating lever cantilever mounted on the brake arm and arranged extending away from the frame for facilitating movement of the brake arm from the disengaged position to the position engaging the support surface by the application of pressure to the lever as by the foot of an operator. In addition, a tension spring, and the like, can be connected to and arranged extending between the actuating lever and the frame for biasing the brake arm toward its disengaged position.

A particularly advantageous feature of the invention is the provision of a frame constructed in a plurality of sections selectively connectible to one another in predetermined numbers to vary the length of the frame. In this manner, a frame of desired length, with a desired number of warning devices, may be easily constructed to satisfy a particular set of conditions.

A preferred embodiment of the signal assembly includes at least one flashing lamp assembly connected to a portable power supply mounted on the frame. The lamp assembly advantageously includes a pole pivotally mounted on the frame for swinging movement between an operative position extending substantially upwardly from the frame and a storage position generally parallel to a longitudinal extent of the frame. In this manner, the barricade can be easily placed in a compact storage mode when not in use.

These together with other objects and advantages which will become subsequently apparent reside in the details of construction and operation as more fully hereinafter described and claimed, reference being had to the accompanying drawings forming a part hereof, wherein the like numerals refer to like parts throughout.

DESCRIPTION OF THE PREFERRED EMBODIMENTS

Figure 1:
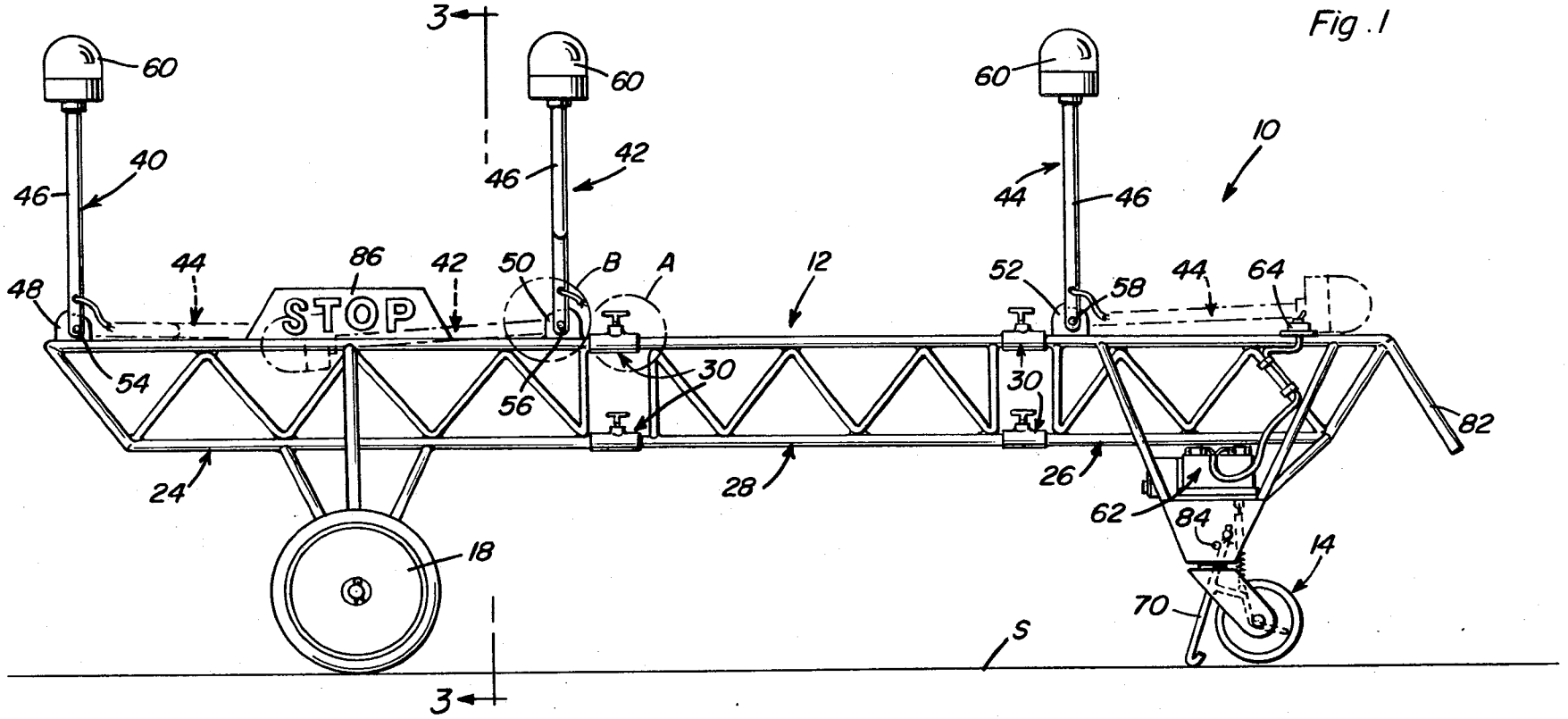
FIG. 1 is a side elevational view showing a portable barricade according to the present invention.
Figure 3:
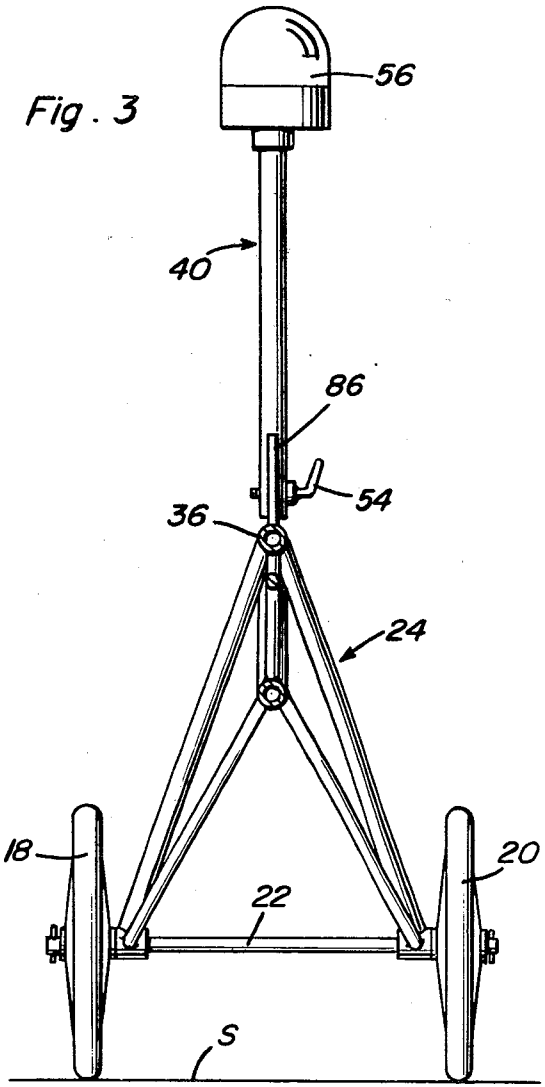
FIG. 3 is a sectional view taken generally along the line 3—3 of FIG. 1.
Figure 2:
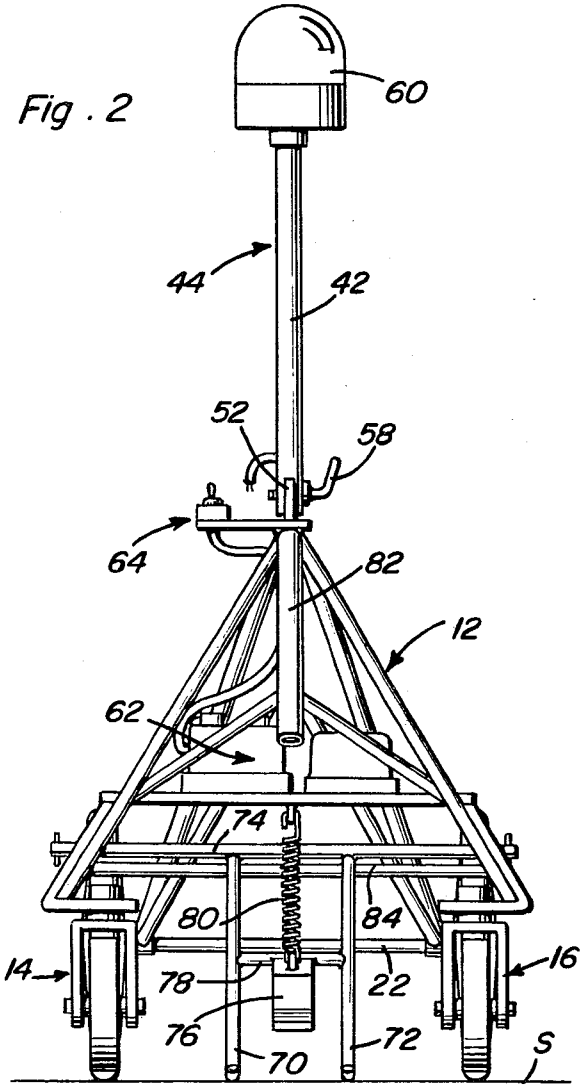
FIG. 2 is an end elevational view taken from the right side of FIG. 1.

Referring now more particularly to FIGS. 1–3 of the drawings, a portable barricade 10 according to the invention includes a frame 12 movable over a support surface as by wheels rotatably mounted on frame 12 for facilitating movement thereof. More specifically, the wheels include a pair of casters 14 and 16 swivel mounted adjacent an end of the frame 12, and a pair of axially spaced, fixed wheels 18 and 20 disposed on an axle 22 attached beneath the frame 12 at the end of frame 12 spaced from the casters 14 and 16. In this manner, frame 12 may be easily manipulated and moved from one place to another by a single person (not shown).

Figure 4:
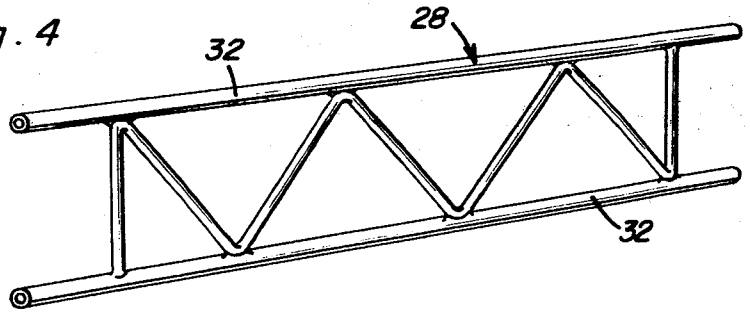
FIG. 4 is a perspective, detail view showing a section of a frame according to the invention which may be employed in predetermined numbers to vary the length of the frame.

Frame 12 further includes a plurality of sections 24, 26 and 28 (FIG. 4) selectively connectible to one another to vary the length of frame 12. As will be readily appreciated, the length of frame 12 can be varied by insertion of any desired number of intermediate sections 28 between the pair of end sections 24 and 26, with the various sections being clamped together in a suitable manner.

Figure 5:
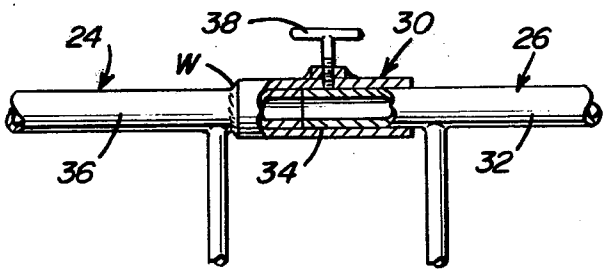
FIG. 5 is a fragmentary, enlarged detail view, partly cut away and in section, taken generally within the circle designated A in FIG. 1.

Referring now to FIG. 5 of the drawings, one manner of attachment of the sections 24, 26 and 28 to one another will now be discussed. As can be readily seen, clamps 30 receive the end portions of rails 32, which partially form the truss-like intermediate sections 28, within a generally cylindrical bore 34. Clamp 30 is itself mounted on an end portion of a rail 36 of section 24, or the corresponding rail of section 26, and is secured thereon in a conventional manner as by welding. A T-screw 38, and the like, is threaded into the wall of clamp 30 in order to retain the end portion of a rail 32 within bore 34. Accordingly, sections 24, 26 and 28 can be connected together in a simple yet rugged manner so as to be readily removed for different configurations of frame 12 and for storage of barricade 10.

A signal arrangement in the form of a plurality of lamp assemblies 40, 42 and 44 is mounted on frame 12 for warning parties approaching the barricade 10 of the presence of a certain hazardous condition. While three lamp assemblies have been shown as mounted on frame 12, it is to be understood that the number of lamp assemblies employed may vary.

Each lamp 40, 42 and 44 is preferably a flashing lamp device, and includes a pole 46 connected to a respective bracket 48, 50 and 52. Each pole 46 is retained on its associated bracket 48, 50, 52 as by a conventional clamping device 54, 56 and 58 which permits the swinging movement of pole 46 between the full line position shown in FIG. 1 and the broken line position shown for lamp assembly 44. In this manner, each lamp assembly 40, 42, 44 is easily pivoted between an operative position, that shown in full lines in FIG. 1, and a storage position, that shown in the broken lines for lamp assembly 44, while being capable of retention in the operative position by the associated hand-actuated clamps 54, 56 and 58.

Figure 6:
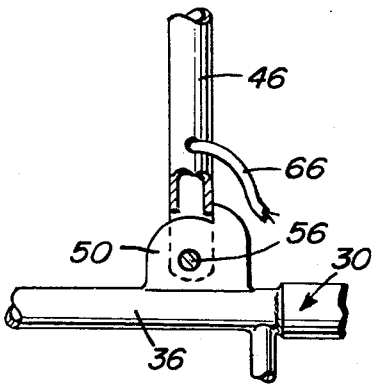
FIG. 6 is a fragmentary, enlarged detail view, partly cut away and in section, taken generally within the circle designated B in FIG. 1.

Each of the lamp assemblies 40, 42 and 44 also includes a conventional lamp 60, preferably of the well known "flashing" type, connected to a suitable power supply 62 which can be mounted beneath the frame 12. A switch 64 also mounted on frame 12 permits on-and-off manipulation of the lamp 60, which are connected to power supply 62, and switch 64, as by a conventional electrical conductor 66 (FIG. 6). Power supply 62 is advantageously a conventional re-chargeable battery pack, such as the conventional lead-acid storage battery used in motor vehicles, and the like.

Figure 7:
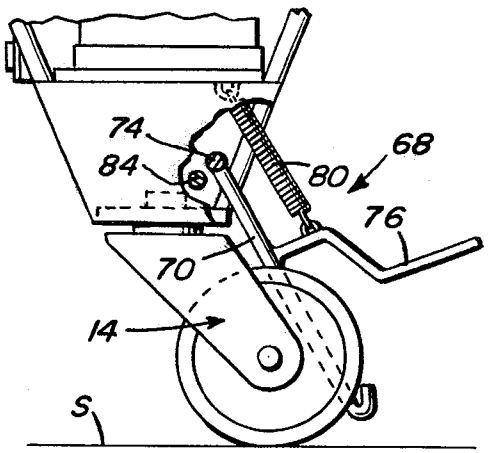
FIG. 7 is a fragmentary, enlarged view, partly cut away and in section, detailing the lower right-hand portion of FIG. 1.

Referring now more particularly to FIG. 7 of the drawings, a brake 68 is mounted on frame 12 for permitting selective retention of barricade 10 in a desired location. The illustrated brake 68 includes a pair of brake arms 70 and 72 pivotally mounted on frame 12 as by a shaft 74 for movement between the disengaged position, shown in FIG. 7, and a position engaging the support surface S supporting frame 12, as shown in FIG. 1, for restaining frame 12 from movement relative to support surface S. Shaft 74 is journaled on frame 12 in a conventional manner, and brake arms 70 and 72 are affixed to the shaft 74 for rotation therewith. As can be appreciated from the drawings, brake arms 70 and 72 are pivotally mounted on frame 12 adjacent the casters 14 and 16 and are of a length sufficient to lift the casters 14 and 16 from the support surface S when brake arms 70 and 72 are in the position engaging support surface S as shown in FIG. 1.

Brake 68 further includes an actuating lever 76 cantilever mounted on the cross bar 78 tying together the pair of brake arms 70 and 72 and arranged extending away from the frame 12 for facilitating movement of the brake arms 70 and 72 from the disengaged position to the position engaging support surface S advantageously by the application of pressure from the foot of a person (not shown) operating barricade 10. A conventional tension spring 80, and the like, is advantageously connected to and arranged extending between actuating lever 76 and frame 12 for biasing brake arms 70 and 72 toward the disengaged position shown in FIG. 7.

Thus, to operate brake 68, the operator press would press down on the foot pedal or actuating lever 76 until the brake arms 70 and 72 touch the paving or other support surface S, and would then pull barricade 10 toward himself as by means of a handle 82. This operation would pull the brake arms 70 and 72 slightly over center and into a lock position against brace 84 as shown in FIG. 1. This action would raise the caster wheels 14 and 16 a short distance off of the support surface S. To unlock brake 68, the operator would push barricade 10 away from himself, with it being understood that the operator would be standing at the end of frame 12 on which handle 82 is provided, and spring 80 would return brake arms 70 and 72 to up position shown in FIG. 7. Thus, position retention of barricade 10 is achieved in a simple yet reliable manner.

It will be appreciated that handle 82 may also be employed to facilitate manipulation of frame 12 during movement thereof.

A sign 86, which may be either lighted or unlighted, can be mounted on one or more of the sections of frame 12, as is illustrated for section 24, in order to provide additional warning of an impending hazard. Further, it will be appreciated that various kinds of warning devices may be mounted on frame 12 as desired and appropriate under certain conditions.

Since barricade 10 is primarily intended to be operated outdoors in all elements, the electrical switch 64 as well as power supply 62 and other elements vulnerable to climatic conditions should be placed in suitable housings which will protect these elements from adverse climatic conditions.

As can be readily understood from the above description and from the drawings, a portable barricade according to the invention will provide a flexible and reliable yet inexpensive device for protecting school crossings and similar hazardous traffic situations. The barricade 10 can be easily moved out into an appropriate location, such as the middle of a crossing, by a single person and left at that location until the need for providing warning has passed, at which time a single person can simply remove the barricade to a place of storage as within a school building or a locked school yard, until such time as the barricade is again required.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A portable barricade for use at school crossings, and the like, comprising, in combination:

a. a frame movable over a support surface;

b. a signal means mounted on the frame for warning parties approaching the barricade of the presence of certain hazardous conditions; and c. brake means mounted on the frame for permitting selective retention of the barricade in a desired location, the brake means including a brake arm pivotally mounted on the frame for moving between a disengaged position and a position engaging the support surface which supports the frame for restraining the frame from movement relative to the support surface, the frame including wheels rotatably mounted thereon for facilitating movement of the frame, the frame having a pair of longitudinally spaced ends, and wherein the wheels include a caster disposed adjacent an end of the frame, with the brake arm being pivotally mounted on the frame adjacent the caster and of a length sufficient to lift the caster from the support surface which supports the frame when the brake arm is in the position engaging the support surface, the brake means further including an actuating lever cantilever mounted on the brake arm and arranged extending away from the frame for facilitating movement of the brake arm from the disengaged position to the position engaging the support surface by the application of foot pressure to the lever, and a tension spring connected to and extending between the actuating lever and the frame for biasing the brake arm toward its disengaged position, the wheels further including a pair of axially spaced, fixed wheels disposed on the frame at the end thereof spaced from the caster, the frame further including a plurality of sections selectively connectible to one another in predetermined numbers to vary the length of the frame, the signal means including a lamp assembly and a power supply connected to the lamp assembly, the lamp assembly including a pole pivotally mounted on the frame for swinging movement between an operative position extending away from the frame and a storage position substantially adjacent the frame, there being a plurality of lamp assemblies each pivotally mounted on the frame, each of the lamp assemblies including a flashing lamp, and the power supply being a re-chargeable battery pack mounted on the frame and including an electrical switch for selectively energizing the flashing lamps.

* * * * *